US006050841A

United States Patent [19]

Chen

[11] Patent Number: 6,050,841

[45] Date of Patent: Apr. 18, 2000

[54] ELECTRIC CONNECTOR

[76] Inventor: Joe Chen, No. 1, Industrial Park 12th Road, Ta-Li City, Taichung Hsien, Taiwan

[21] Appl. No.: 09/249,804

[22] Filed: Feb. 16, 1999

[51] Int. Cl.[7] ..... H01R 4/24

[52] U.S. Cl. ..... 439/402; 403/395; 403/397

[58] Field of Search ..... 439/402, 403, 439/395, 396, 417

[56] References Cited

U.S. PATENT DOCUMENTS

| | | | |
|---|---|---|---|
| 3,388,370 | 6/1968 | Elm | 339/98 |
| 3,793,356 | 2/1974 | Johansson et al. | 339/98 |
| 3,912,356 | 10/1975 | Johansson | 339/98 |
| 4,283,104 | 8/1981 | Pemberton | 339/97 |
| 4,370,009 | 1/1983 | Dola | 339/91 |

*Primary Examiner*—Gary F. Paumen
*Assistant Examiner*—Alexander Gilman
*Attorney, Agent, or Firm*—Rosenberg, Klein & Lee

[57] ABSTRACT

An electric connector includes a base seat and an electric conductive member. The conductive member is formed with notches and bent sections having bending angles. The bending angles can be changed to vary the gap between a free face of the bent section and an inner face of the notch to meet the requirement of different diameters of conductive wires. The conductive wires can be firmly fixedly electrically connected with each other by the conductive member so that it is no more necessary to prepare various kinds of electric connectors with different wire diameters. Therefore, the stock amount is reduced and the products can be easily distinguished from each other. Also, the assembling operation is facilitated and the possibility of mis-assembling is minimized.

5 Claims, 6 Drawing Sheets

ELECTRIC CONNECTOR

BACKGROUND OF THE INVENTION

The present invention relates to an electric connector including an electric conductive member. The conductive member is formed with notches and bent sections having bending angles. The bending angles can be changed so as to vary the gap between a free face of the bent section and an inner face of the notch. Therefore, the electric connector is applicable to the connection between various diameters of conductive wires.

FIG. 9 shows an existing electric connector including a base seat 9 and an electric conductive plate 91. The conductive plate 91 is a panel-like member formed with two notches 911. Two sides of the open end of each notch 911 are formed with slope faces defining a sharp angle 912. One side of the base seat 9 is connected with a cover body 92. A free end of the cover body 92 is disposed with a hook section 921. The other side of the base seat 9 is formed with an insertion channel 93. The base seat 9 is formed with two wire passages 94A, 94B for conductive wires 96A, 96B to insert therein. One end of one of the wire passages 94B is disposed with a stopper section (not shown). The base seat 9 is further formed with a connecting slot 95 perpendicular to the middle sections of the wire passages 94A, 94B and communicating therewith.

When assembled, the conductive wires 96A is placed into the wire passage 94A and the other conductive wire 96B is inserted into the inner side wire passage 94B. The stopper section serves to restrict the insertion depth of the conductive wire 96B. The stopper section is formed at one end so that the connecting slot 95 can intersect both the conductive wires 96A, 96B. The conductive plate 91 is inserted into the connecting slot 95 and the cover body 92 is closed up with the hook section 921 hooking the insertion channel 93. Under such circumstance, the cover body 92 presses the conductive plate 91, making the sharp angles 912 thereof thrust through the insulated skins around the conductive wires 96A, 96B so as to electrically connect the cores of the conductive wires 96A, 96B with the conductive plate 91.

The above electric connector can be easily assembled. However, such electric connector can be applied to at most two kinds of wire diameters (inner side and outer side). In actual use, there are many kinds of wire diameters. In order to meet different wire diameters, the wire passages 94A, 94B of the base seat 9 and the notches 911 of the conductive plate 91 must have different sizes and distances so as to successfully thrust through the insulated skins of the conductive wires and fixedly electrically connect the conductive plate with the wires. This means that it is necessary to prepare various electric connectors with many kinds of wire diameters for use in different sites according to different requirements. As a result, the stock amount will be relatively high and the products are apt to confuse with each other and mis-assembled to form defective products.

SUMMARY OF THE INVENTION

It is therefore a primary object of the present invention to provide an electric connector including a base seat and an electric conductive member inserted into the base seat for electrically connecting two conductive wires with each other. The conductive member is formed with notches and bent sections having bending angles. The bending angles can be changed so as to vary the gap between a free face of the bent section and an inner face of the notch to meet the requirement of different diameters of conductive wires. The conductive wires can be firmly fixedly electrically connected with each other by the conductive member so that it is no more necessary to prepare various kinds of electric connectors with different wire diameters. Therefore, the stock amount is reduced and the products can be easily distinguished from each other. Also, the assembling operation is facilitated and the possibility of mis-assembling is minimized.

The present invention can be best understood through the following description and accompanying drawings, wherein:

DETAILED DESCRIPTION OF THE PREFERRED EMBODIMENTS

Figure 1:
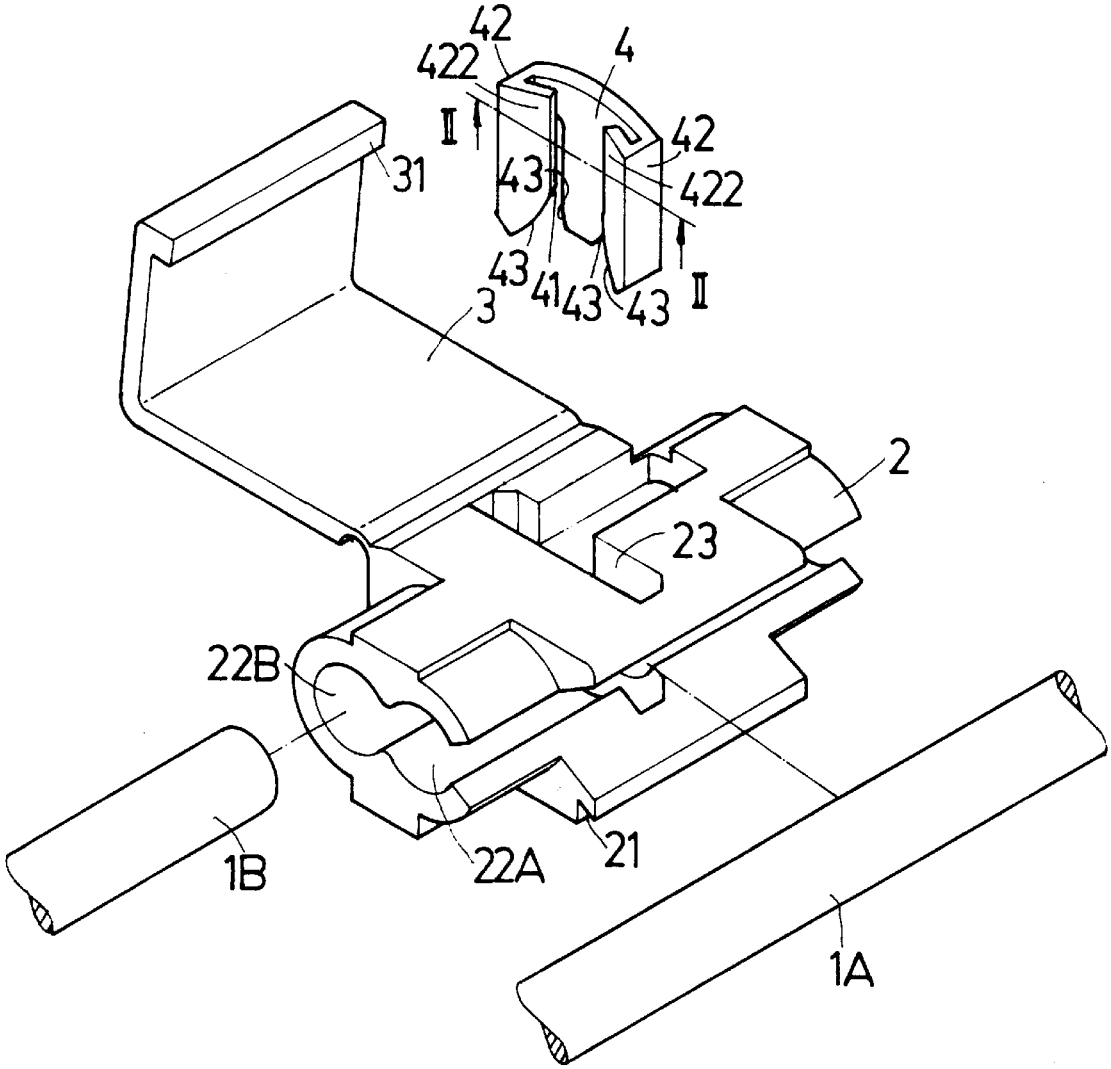
FIG. 1 is a perspective exploded view of the present invention.
Figure 2:
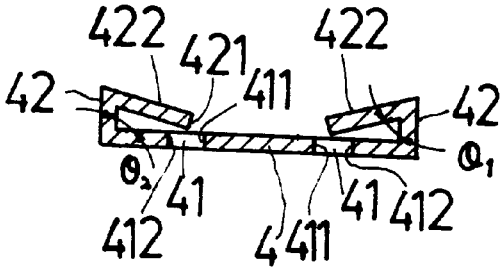
FIG. 2 is a sectional view of the electric conductive member of the present invention, taken along line II—II of FIG. 1.

Please refer to FIGS. 1 to 8. The present invention includes:

a base seat 2 one side of which is connected with a cover body 3, a free end of the cover body 3 being disposed with a hook section 31, the other side of the base seat 2 being formed with an insertion channel 21, an inner and an outer sides of the base seat 2 being respectively formed with two wire passages 22A, 22B for conductive wires 1A, 1B to insert therein, the base seat being further formed with a connecting slot 23 perpendicular to the middle sections of the wire passages 94A, 94B and communicating therewith, each lateral faces of the connecting slot 23 being formed with an expansion section 24, one end of one wire passage 22B being disposed with a stopper section 221; and an electric conductive member 4 formed of an electrically conductive metal plate by bending, the conductive member 4 being formed with two notches 41 upward extending from a bottom end of the conductive member 4, each notch 41 having an inner face 411 and an outer face 412, each lateral side of the conductive member 4 being formed with a bent section 42 connected with a movable board 422, a free face 421 of the movable board 422 being horizontally positioned near a space between the inner and outer faces 411, 412 of the notch 41, a cut section being formed at a bottom end of each of the inner and outer faces 411, 412 of the notch 41 and the free face 421 of the movable board 422, the cut section 43 of the free face 421 having an arch face, the cut section 43 of each of the inner and outer faces 411, 412 having two slope faces.

Figure 3:
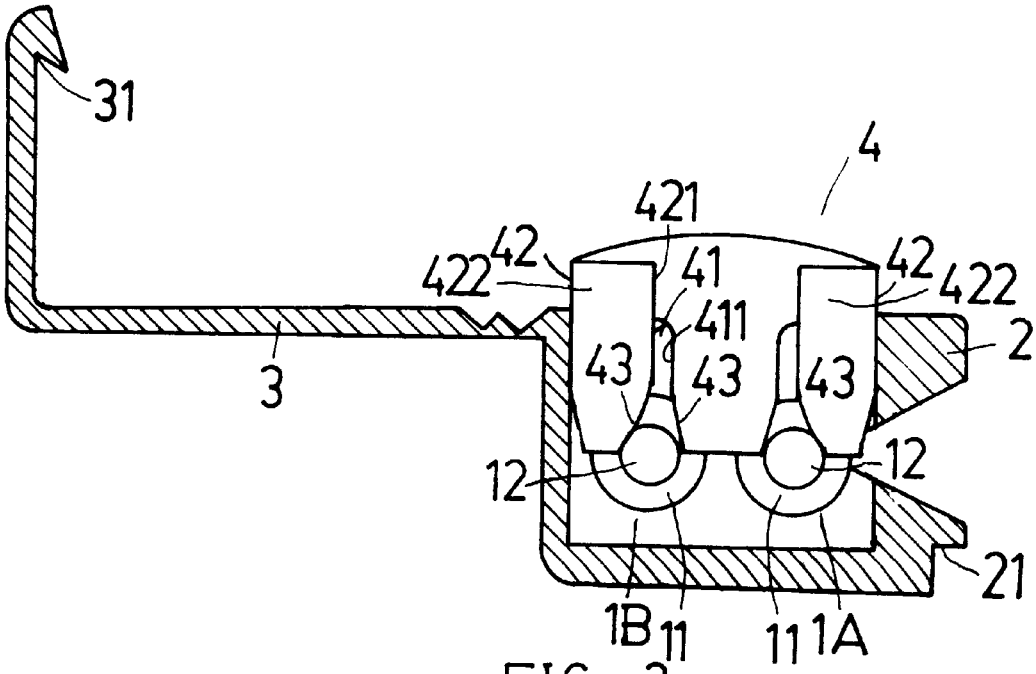
FIG. 3 is a side sectional view showing that the cut sections of the present invention thrust through the insulated skin of a coarse conductive wire.

When assembled, the conductive wire 1A is placed into the wire passage 22A. The other conductive wire 1B is inserted into the other wire passage 22B, the stopper section 221 serves to restrict the insertion depth of the conductive wire 22B. The stopper section 221 is formed at one end so that the connecting slot 23 can intersect both the conductive wires 1A, 1B. The conductive member 4 is inserted into the connecting slot 23 and the cover body 3 is closed up with the hook section 31 hooking the insertion channel 21. Under such circumstance, the cover body 3 presses the conductive member 4, making the cut sections 43 at the bottom end thereof thrust through the softer insulated skins 11 around the conductive wires 1A, 1B until reaching the harder core material 12 as shown in FIG. 3. At this time, the bending angles are enlarged and the bent sections 42 are outward expanded by means of the space of the expansion sections 24. Therefore, the gap between the free face 421 and the inner face 411 of the notch 41 is enlarged so as to electrically connect the core materials 12 of the conductive wires 1A, 1B with the conductive member 4 and fixedly clamp the core materials 12.

Figure 4:
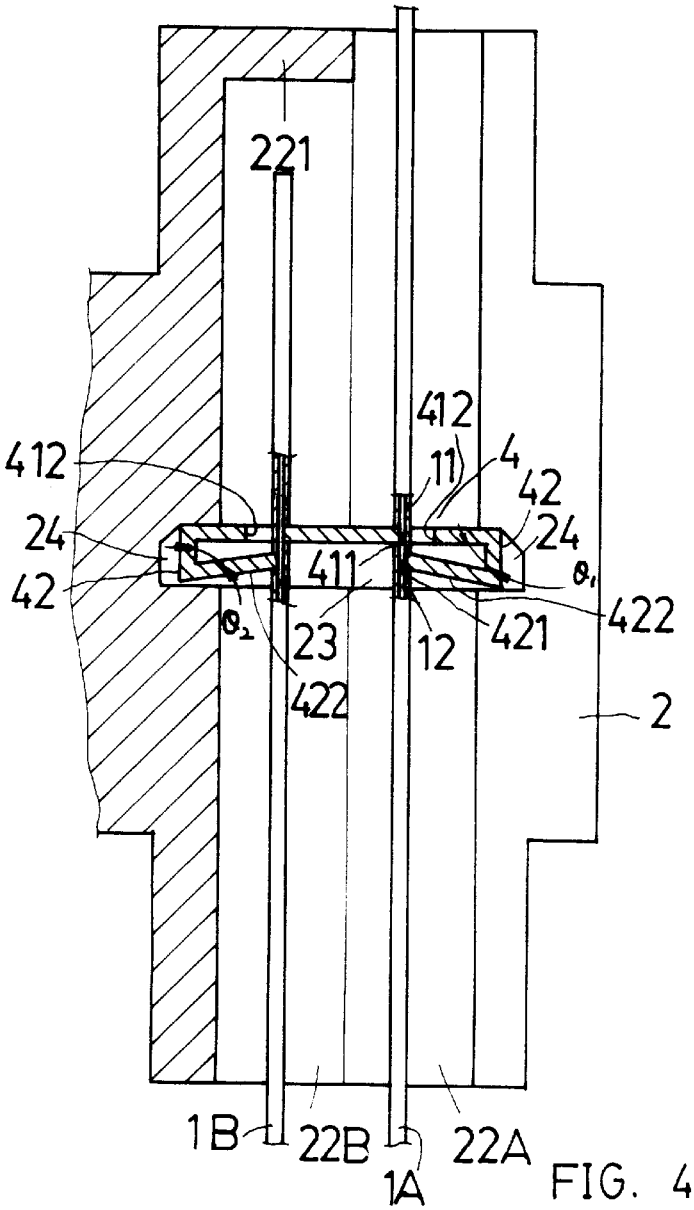
FIG. 4 is a top view showing that the core material of a slender conductive wire forces the free faces of the movable boards to expand outward.
Figure 5:
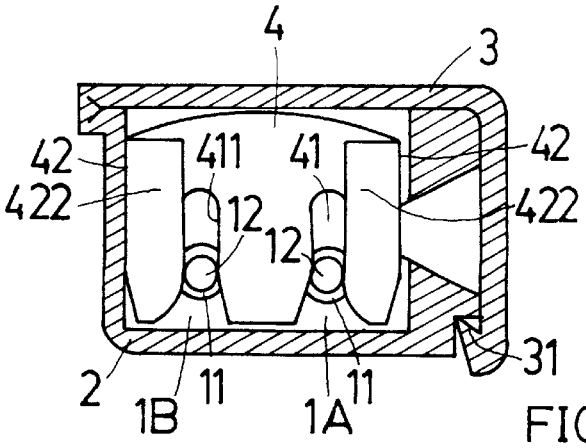
FIG. 5 is a side view showing that the core material of a slender conductive wire forces the free faces of the movable boards to expand outward.
Figure 6:
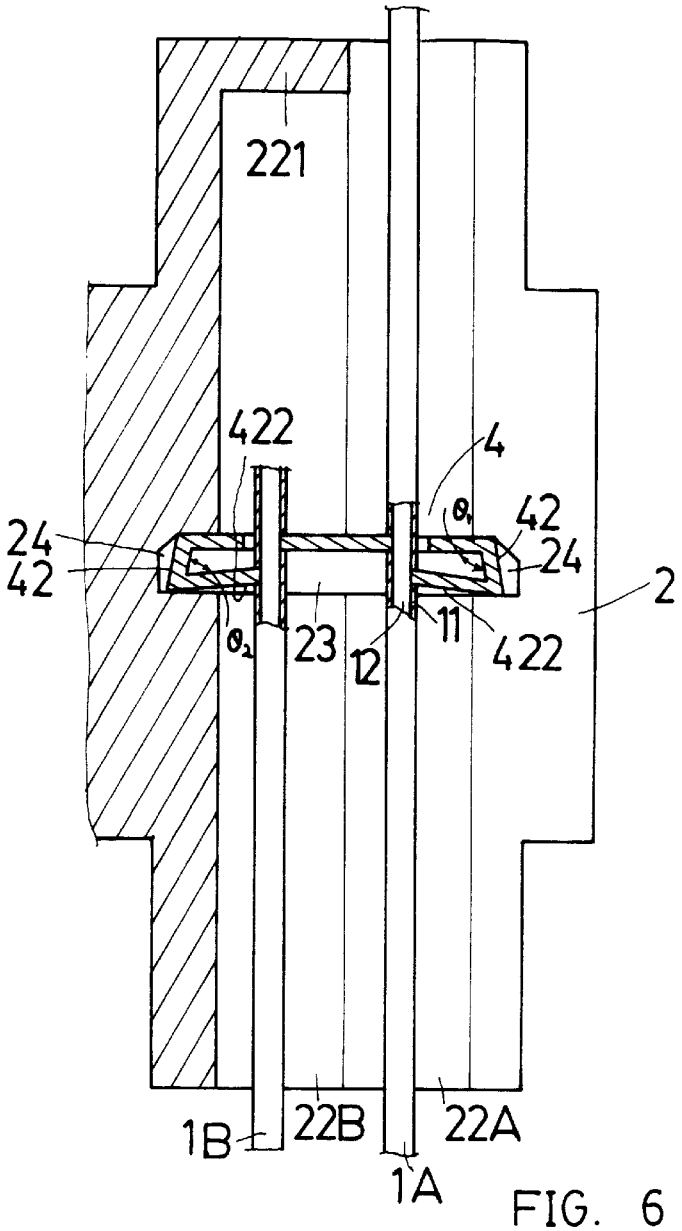
FIG. 6 is a top view showing that the core material of a coarse conductive wire forces the free faces of the movable boards to expand outward.
Figure 7:
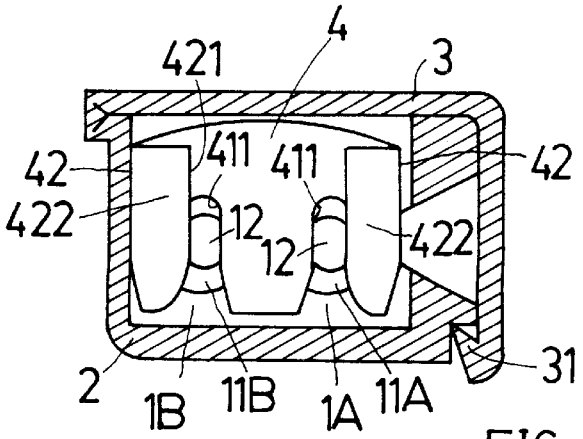
FIG. 7 is a side view showing that the core material of a coarse conductive wire forces the free faces of the movable boards to expand outward.

The bending angles of the bent sections 42 can be changed so as to vary the gap between the free face 421 and the inner face 411 of the notch 41 to meet the requirement of different diameters of conductive wires. Therefore, the range of the wire diameter receivable in the notch 41 is widened. That is, when applied to a slender conductive wire, the gap between the cut section 43 of the free face 421 and the cut section 43 of the inner face 411 of the notch 41 is less. Therefore, the cut sections 43 cut apart the insulated skin 11 by a shorter distance until reaching the core material 12 which has higher hardness and cannot be cut apart to forcedly enlarge the bending angles of the bent sections 42. Accordingly, the gap between the free face 421 and the inner face 411 of the notch is enlarged so as to fixedly clamp the wire as shown in FIGS. 4 and 5. When applied to a coarse conductive wire, the gap between the cut section 43 of the free face 421 and the cut section 43 of the inner face 411 of the notch 41 is larger. Therefore, the cut sections 43 cut apart the insulated skin 11 by a longer distance so as to enlarge the bending angles of the bent sections 42 more. At this time, the conductive wires are fixedly clamped as shown in FIGS. 6 and 7.

Figure 8:
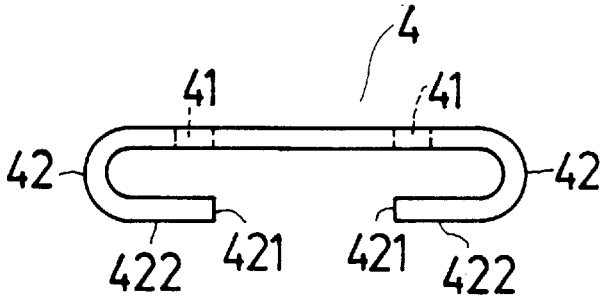
FIG. 8 is a top view of a second embodiment of the present invention.
Figure 9:
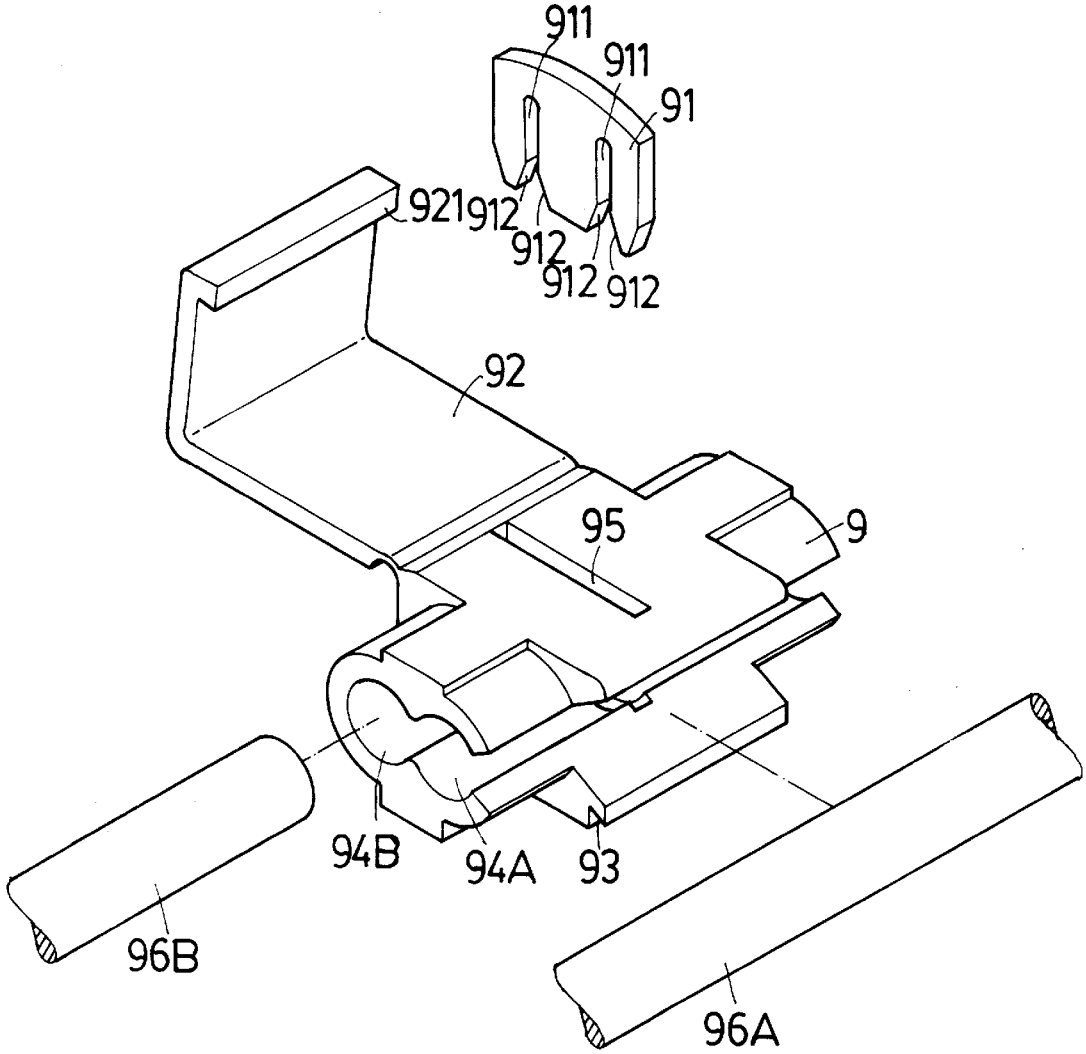
PRIOR ART FIG. 9
FIG. 9 is a perspective exploded view of a conventional electric connector.

FIG. 8 shows a second embodiment of the present invention, in which the conductive member 4 has a bent section 42 with a round angle.

In conclusion, the bending angles of the bent sections 42 of the conductive member can be changed so as to vary the gap between the free face 421 and the inner face 411 of the notch 41 to meet the requirement of different diameters of conductive wires. The conductive wires can be firmly fixed and it is no more necessary to prepare various kinds of electric connectors with different wire diameters. Therefore, the stock amount is reduced and the products can be easily distinguished from each other. Therefore, the assembling operation is facilitated and the possibility of misassembling is minimized.

It is to be understood that the above description and drawings are only used for illustrating some embodiments of the present invention, not intended to limit the scope thereof. Any variation and derivation from the above description and drawings should be included in the scope of the present invention.

What is claimed is:

1. An electric connector comprising:

a base seat one side of which is connected with a cover body, a free end of the cover body being disposed with a hook section, the other side of the base seat being formed with an insertion channel, the base seat being respectively formed with at least two wire passages for conductive wires to insert therein, the base seat being further formed with a connecting slot perpendicular to middle sections of the wire passages and communicating therewith;

an electric conductive member formed of an electrically conductive metal plate by bending, the conductive member being inserted into the connecting slot, the conductive member being formed with at least two notches upward extending from a bottom end of the conductive member, each notch having an inner face and an outer face; wherein:

each lateral face of the connecting slot is formed with an expansion section, each lateral side of the conductive member being formed with a bent section connected with a movable board, a free face of each movable board being horizontally positioned near a space between the inner and outer faces of the corresponding notch, the inserted wire being cut at a bottom end of each of the inner and outer faces of the corresponding notch and the free face of the corresponding movable board.

2. An electric connector as claimed in claim 1, wherein one end of one of the wire passages is disposed with a stopper section.

3. An electric connector as claimed in claim 1, wherein the cut section of the free face has an arch face, while the cut section of each of the inner and outer faces has two slope faces.

4. An electric connector as claimed in claim 1, wherein the bent section is bent with two bending angles.

5. An electric connector as claimed in claim 1, wherein the bent section is bent with a round angle.

* * * * *